US012433354B2

(12) United States Patent
Perry

(10) Patent No.: US 12,433,354 B2
(45) Date of Patent: Oct. 7, 2025

(54) FACE COVERING

(71) Applicant: Shawn F D Perry, Winnipeg (CA)

(72) Inventor: Shawn F D Perry, Winnipeg (CA)

( * ) Notice: Subject to any disclaimer, the term of this patent is extended or adjusted under 35 U.S.C. 154(b) by 405 days.

(21) Appl. No.: 17/701,666

(22) Filed: Mar. 23, 2022

(65) Prior Publication Data

US 2023/0301376 A1 Sep. 28, 2023

Related U.S. Application Data

(60) Provisional application No. 63/218,278, filed on Jul. 3, 2021, provisional application No. 63/210,064, filed on Jun. 13, 2021, provisional application No. 63/197,397, filed on Jun. 6, 2021, provisional application No. 63/192,192, filed on May 24, 2021, provisional application No. 63/191,049, filed on May 20, 2021, provisional application No. 63/182,969, filed on May 2, 2021, provisional application No. 63/176,324, filed on Apr. 18, 2021, provisional application No. 63/174,034, filed on Apr. 13, 2021, provisional application No. 63/170,721, filed on Apr. 5, 2021.

(51) Int. Cl.
*A41D 13/11* (2006.01)

(52) U.S. Cl.
CPC ..... *A41D 13/1161* (2013.01); *A41D 13/1192* (2013.01); *A41D 2300/32* (2013.01); *A41D 2400/42* (2013.01)

(58) Field of Classification Search
CPC ..... A41D 13/11; A41D 13/1161; A41D 13/1169; A45F 2005/023; A62B 18/02; A62B 18/025
USPC ..... 2/249, 250, 251
See application file for complete search history.

(56) References Cited

U.S. PATENT DOCUMENTS

| | | | | |
|---|---|---|---|---|
| 4,055,873 | A * | 11/1977 | Kallman | A45F 5/02 224/901.4 |
| 4,394,012 | A * | 7/1983 | Egbert | A63B 21/065 2/250 |
| 2006/0107443 | A1* | 5/2006 | DeRosa | A41D 1/08 2/228 |
| 2013/0105528 | A1* | 5/2013 | Enayati | A45F 5/021 224/191 |
| 2021/0127770 | A1* | 5/2021 | Chun | A45C 3/001 |
| 2021/0345694 | A1* | 11/2021 | Volk | A41D 13/1161 |
| 2021/0345713 | A1* | 11/2021 | Yates | A41D 15/005 |
| 2022/0039482 | A1* | 2/2022 | Bauer | A41D 27/20 |
| 2023/0405372 | A1* | 12/2023 | Schwager | A41D 13/113 |

FOREIGN PATENT DOCUMENTS

CN 207341220 U * 5/2018

OTHER PUBLICATIONS

CN 207341220U translation (Year: 2017).*

* cited by examiner

*Primary Examiner* — Rachael E Bredefeld
*Assistant Examiner* — Seth R. Brown

(57) ABSTRACT

A face covering generally worn to cover the nose and mouth of a user where the face covering includes attachments that are capable of engaging other surfaces including apparel items and wears.

20 Claims, 8 Drawing Sheets

FACE COVERING

CROSS-REFERENCE TO RELATED APPLICATIONS

This application claims the benefit of U.S. Provisional Patent Application No. 63/218,278 filed on Jul. 3, 2021, U.S. Provisional Patent Application No. 63/210,064 filed on Jun. 13, 2021, U.S. Provisional Patent Application No. 63/197,397 filed on Jun. 6, 2021, U.S. Provisional Patent Application No. 63/192,192 filed on May 24, 2021, U.S. Provisional Patent Application No. 63/191,049 filed on May 20, 2021, U.S. Provisional Patent Application No. 63/182,969 filed on May 2, 2021, U.S. Provisional Patent Application No. 63/176,324 filed on Apr. 18, 2021, and U.S. Provisional Patent Application No. 63/174,034 filed on Apr. 13, 2021 and U.S. Provisional Patent Application No. 63/170,721 filed on Apr. 5, 2021.

FIELD OF INVENTION

The present invention relates to face coverings that provide protection from infectious disease, airborne pollutants, dust, particulates, pathogens or the like, more particularly, to the storage and/or transportation and deployment of said face coverings.

BACKGROUND

This invention is directed to storage, transportation and deployment of face coverings.

It is well known that wearing face coverings such as surgical masks, N95 and KN95 respirator masks, cone masks, cloth masks, or the like provide personal protection from dust, airborne pollutants, particulates, infectious disease or similar and help to prevent the spread of such disease.

A known method of transporting or storing a face covering is to place the face covering in a plastic or paper bag. Storage of face coverings in this manner requires cumbersome physical manipulation and excessive hand contact of the face covering and bag that may cause cross contamination and facilitate the spread of infectious disease or the like.

Additionally, the user is faced with the difficulty of carrying a multiplicity of bags; one bag for clean face coverings and one bag for used face coverings and in some cases another bag to carry both the other bags. This multiple bag carrying method is often abandoned as the wearer of the face covering finds such bag storage cumbersome and impractical.

Another method used to store a face covering is the use of a lanyard which is placed around the user's neck where the face covering dangles open under the user's facial area. While this method provides a location of storage near the users body it is not readily deployable and, in many cases, creates a hazard as the lanyard dangles from the users neck. Additionally, the location does not provide protection from outside contamination such as, but not limited to food and droplets from the facial area.

An additional problem that exists for first responders and individuals engaged in physical activities or high intensity activities is the need for rapid deployment of face coverings. It is known that a face covering needs to be replaced if the face covering becomes fouled, damaged or moist from sweat or the like. As such, individuals that require face coverings to be changed or replaced on a regular basis find it impractical and impossible to store face coverings in plastic or paper bags or have face coverings dangling around the neck area.

What is needed and provided with this invention is a face covering and face covering system that reduces cross-contamination, that is effortlessly stored, transported and readily available for rapid deployment.

BRIEF SUMMARY OF THE INVENTION

According to one aspect of the invention there is a face covering with a fastening member or plurality of fastening members sewn or attached to the face covering such as a hook-and-loop (Velcro™) type, magnetic type, snap button type or the like. The fastening member of the face covering is capable of readily engaging a corresponding fastening member sewn or attached to a clothing wear, armband, removable patch, openable patch or other surface, item or the like.

In another aspect the hook-and-loop (Velcro™) fastening material is sewn or attached to the inner and outer surface, seam, hem or the like of a face covering allowing a plurality of face coverings to be grouped cohesively in one bundle.

In another aspect of the invention there is a face covering wherein a plurality of fastening members sewn or attached to the face covering allow the face covering to be folded and secured generally in half.

In another aspect the hook-and-loop (Velcro™) fastening material, snap button, or the like is sewn or attached to the face covering as a tag. This tag may provide identification as to the face covering material type and rating, laundry and care instructions, identification instructions including, logos or the like. Additionally, this tag may be intentionally blank for personal identification writing know to the user, such as, but not limited to personal names, initials, symbols or nicknames that identify the user. Furthermore, the tag may be used as a closure for retaining the face covering in a generally folded in half manner preventing the inside of the face covering from contacting other surfaces when not worn about the face of the wearer.

In another aspect the hook-and-loop (Velcro™) fastening material, snap buttons, magnets or the like that are sewn or attached to the face covering may accept corresponding hook-and-loop type material, snap buttons, magnets or the like sewn or attached to other material or fabric for identification purposes.

In yet another aspect there is provided clothing wears with attachment areas for affixing or releasable engaging with a face covering.

In yet another aspect there is provided an openable patch for holding a face covering by a strap(s) or the ear loops or hook-and-loop materials that are formed as part of clothing wear or formed to be releasable removable.

In yet another aspect the openable patch hook and loop material extends continuously from the patch cover to the clothing wear, wherein the inside surface(s) is continuous, constructed of hook and loop material that is self-engaging wherein the hooks and the loops are woven into the same material that is configured to be in either, the open position, or closed position.

In yet another aspect there is provided a "kit" comprising a face covering and adhesively affixable hook-and-loop (Velcro™) fastening materials where a first fastener member of the hook-and-loop (Velcro™) fastener is adhesively affixed to the face covering and a second member of a hook-and-loop (Velcro™) fastener is adhesively affixed to an outer surface of an apparel wear, or other surface such as a seatback, wall, desk or the like.

In yet another aspect there is a deployable shipping bag that holds or retains a face covering within the shipping bag for purposes of shipping and for purposes other than shipping, wherein the deployable shipping bag has fastening members attached to the exterior surface for purpose of engaging with apparel wears, or another surface such as a seatback, wall, desk or the like.

In yet another aspect there is provided a "kit" that may include combinations of a face covering, a tag, hook-and-loop material, identification patches, clothing wears, armband, cover patch, removable patch, a cover, hook-and-loop backed deployable shipping bag, adaptor patch.

BRIEF DESCRIPTION OF THE DRAWINGS

FIG. 11*aa* is illustration of an attachment area.

FIG. 11*ab* is a side view of an open cover patch.

FIG. 11*ac* is a side view of a closed cover patch.

FIG. 11*ad* is a face covering held with a cover patch.

FIG. 11*ae* is perspective view of a cover patch affixed to a clothing wear such as an arm or leg band.

DETAILED DESCRIPTION

Figure 1:
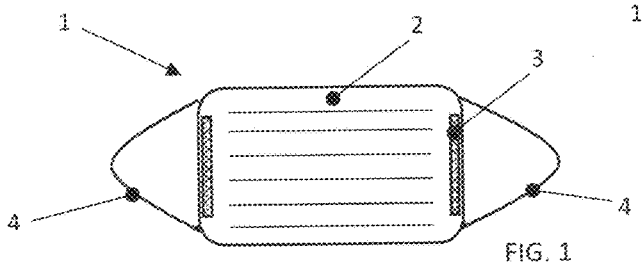
FIG. 1 is an illustration of the front of a face covering with a plurality of fastening members.
Figure 2:
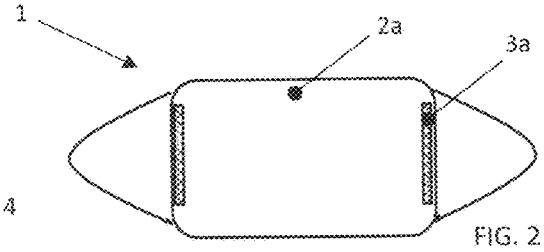
FIG. 2 is an illustration of the back of a face covering with a plurality of fastening members.

Description will now be given in detail according to exemplary embodiments disclosed herein, with reference to the accompanying drawings. It should be understood that various embodiments of the present invention are possible including shape, structure and materials, as such, other embodiment variations are to be considered to be part of this disclosure. The drawings are provided to easily understand various features and it should be understood that the embodiments or articles presented herein are not limited by the accompanying drawings. Also, it should be noted that positions or placements of individual components may be changed without departing from the spirit and scope of the present invention. Reference numerals and letters or combinations or numerals and letters in the drawings may designate the same or similar parts in many aspects without repetition of the descriptive writing. The invention will be described in enough detail that those skilled in the art are able to understand the present invention.

The term clothing wear, apparel wear or apparel is to be understood as garments and other devices, items or similar to be worn by mankind to adorn, cover or protect the head, face, human body or person.

The above forementioned clothing wear, apparel wear or apparel is to include outer wears including accessory wears, such as armbands or leg bands and reflective apparel, such as safety vests or similar or medical wearing apparel, such as scrubs or lab coats or athletic wearing apparel, such as T shirts, jerseys, sweaters or uniform wearing apparel, such as shirts, chef's jacket, tunics and tactical wears or work wearing apparel, such as coveralls or outer wearing apparel, such as jackets.

The term or use of the wording "corresponding fastener" is to be understood as a fastening portion or a corresponding or mating part of a two-part fastening system that releasably engages with a fastening member of a face covering. Wording such as, corresponding hook or loop, hook-and-loop material, attachment areas and snag free fasteners are to be considered a "corresponding fastener" when sense can be made. It should also be understood hook and loop material may be self-engaging, wherein the hooks and the loops are woven into the same material.

In further explanation of said self-engaging hook and loop material, it is to be understood that hook and loop material that is self-engaging may be a fastening member and/or a corresponding fastener.

As used herein, the use of singular terms may include plural or plural may be singular where sense can be made.

Figure 11:
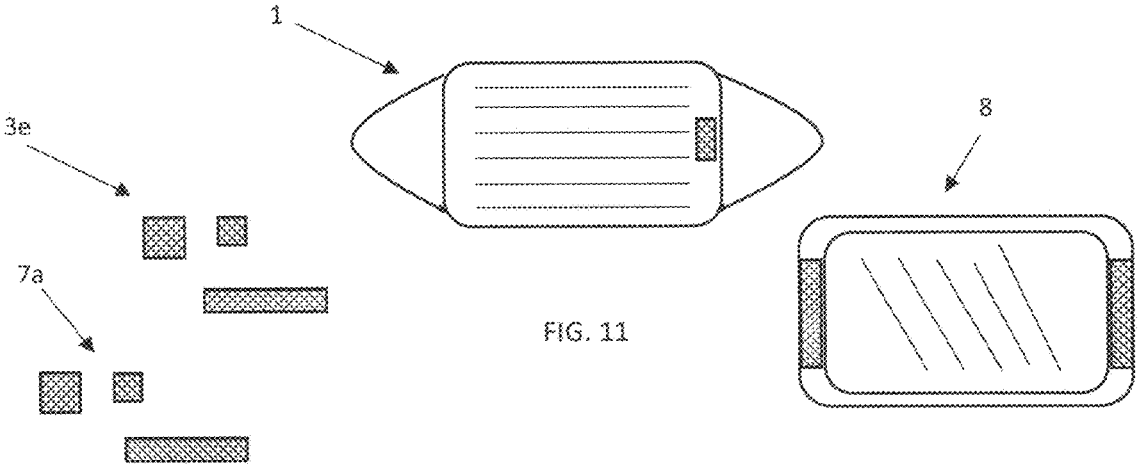
FIG. 11 is an illustration of a face covering kit.

Referring to the FIGS there is provided a face covering 1 such as, but not limited to surgical and respiratory type masks, balaclavas, neck gaiters, cloth masks, bandanas or similar type face coverings 1 used generally to fit over the nose and mouth of a wearer, that includes an inside surface 2*a*, the surface proximal to the face of the wearer, and an outside surface 2, the surface distal to the face of the wearer. The inside surface 2*a* and outside surface 2 or a hem, seam or the like of the face covering 1 may have a fastening member 3, 3*a*, 3*c* or plurality of fastening members 3, 3*a*, 3*c* of a two-part hook-and-loop (Velcro™) material or snap buttons (not shown), magnets (not shown), or other attachment means (not show) sewn or attached to the face covering 1 or into the face covering 1 for the purpose of releasably engaging a face covering 1 to another object, surface, item, clothing wear 6 (FIGS. 11*b*, 11*c*, 12, 13, 14 and 15) armband 6*a* (FIG. 11*ee*), openable patch (FIG. 23) or the like.

A preferred two-part attachment method is illustrated with hook-and-loop (Velcro™) type material that when pressed together, cause the loops to receive the hooks. It is to be understood that the loop portion and the hook portion of a two-part system are interchangeable, wherein either part could appear on the face covering 1, as part of the tag 3*b*, clothing wear 6, armband 6*a*, deployment shipping bag 10, removable patch 9, cover patch 7*c*, openable patch (FIG. 11*ab*, 11*ac*, 19, 20, 23, 24) or other item or surface including the ear loops 4 of a face covering 1. In some aspects the hook-and-loop material fasteners or fastening member 3, 3*a*, 3*c* may incorporate the hooks and loops into one piece such as (Velcro.™.) brand sew on snag free fasteners 7*i*.

Figure 4:
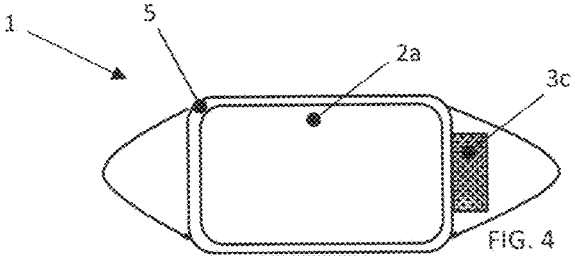
FIG. 4 is an illustration of the back of a face covering with a tag.
Figure 5:
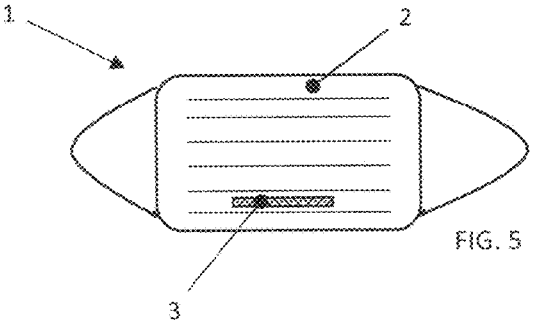
FIG. 5 is an illustration of the front of a face covering with a fastening member.

In one preferred configuration the face covering 1 fastening members 3 sewn or attached to the inside surface 2*a* could be a loop portion and the outside surface 2 could be the hook portion of a hook-and-loop type fastener (Velcro™). The fastening members 3, 3*a* and 3*c* are operably attached to the face covering 1 sewn, adhesively affixed or the like to the inside surface 2*a* and/or outside surface 2 near or on a seam, hem, ear loop 4 or tag 3*c* in a manner comfortable for the wearer that does not interfere with the face covering 1 seal 5 (FIG. 4). Where applicable the face covering 1 (FIG. 9*a*, 18) fastening members 3 hook portion on the outside surface 2 could be positioned or lined up with the fastening members 3*a* loop portions on the inside surface 2*a* in a manner that permits the fastening members 3 and fastening members 3*a* to be parallel when the face covering 1 is folded generally in half. This parallel positioning allows the face covering 1 to be releasably attached to another surface (not show) or clothing wear 6 (FIG. 12) at the corresponding hook 7*b* or loop 7*a* portion of a hook-and-loop type fastener (Velcro™). However, the fastening members 3 and fastening members 3*a* illustrated in FIG. 18 may be similar hook-and-loop type materials where both the fastening members 3 and 3*a* are the loop portions. When the face covering 1 is generally folded in half the fastening members 3 and fastening members 3*a* can engage the corresponding fastener 7 of a clothing wear 6 (FIG. 11*b*), armband (FIG. 11*ae*), removable patch 9 (FIG. 19, 20), openable patch (FIG. 11*ab*, 11*ac*, 19, 20, 23, 24) or other apparel wear, surface or item.

Figure 3:
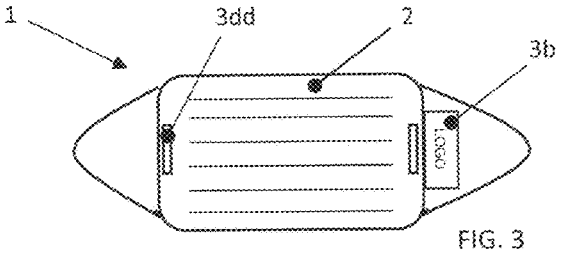
FIG. 3 is an illustration of the front of a face covering with a tag.
Figure 9:
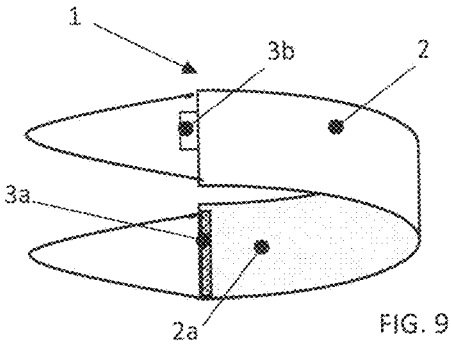
FIG. 9 is a perspective view of a face covering.
Figure 10:
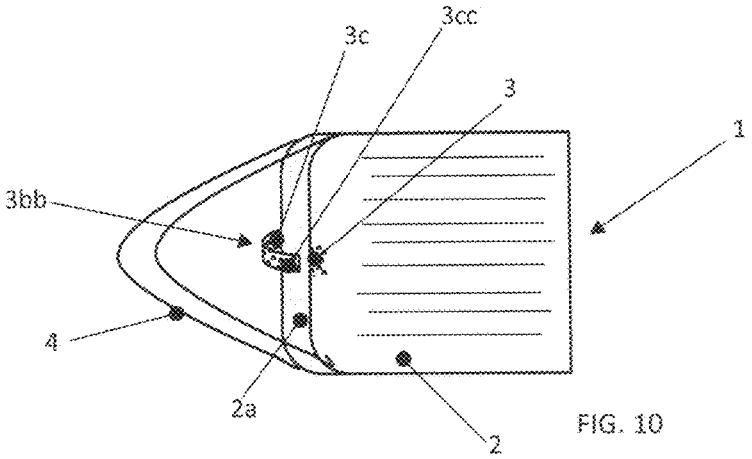
FIG. 10 is a perspective view of a face covering with a closure.

In some aspects a fastening member 3 is sewn or attached to the face covering 1 as a tag 3*b* (FIGS. 3, 4 and 9). The tag 3*b* may be located at any point on the outside surface 2 of the face covering 1, however a preferred location is generally near the seam or hem of the inside surface 2*a* or outside surface 2 of the face covering 1. This tag 3*b* may provide identification as to the face covering 1 material type and rating, laundry and care instructions, identification instructions including, logos or the like. Additionally, this tag 3*b* may be intentionally blank on the side opposite of the fastening member 3*c* (FIG. 4) for personal identification writing known to the user and identifiable to others, such as, but not limited to personal names, initials, symbols or nicknames that identify the user. The tag 3*b* may additionally be used as a closure 3*bb* (FIG. 10) for retaining the face covering in a generally folded assembly where the inside surface 2*a* of the face covering 1 is shielded by the outside surface 2 preventing the inside surface 2*a* from contact with other surfaces. The closure 3*bb* inside surface 3*c* and outside surface 3*cc* may be a two-part hook-and-loop (Velcro™) material where the closure 3*bb* inside surface 3*c* engages the fastening member 3 sewn or attached to the face covering 1 and the outside surface 3*cc* engages the corresponding fastener 7 (FIG. 12) of a clothing wear 6 (FIGS. 12, 13 and 14) or another object, surface, item, or similar (not shown). Optionally, the tag 3*b* may be provided loosely, not sewn or attached to the face covering 1 but releasably attached to a fastening member 3 where the user could remove the tag 3*b* and place as needed for a closure holding the face covering 1 in a generally folded assembly. Additionally, the face covering 1 could be provided with slits 3*dd* (FIG. 3) or openings for inserting same loosely provided tag 3*b*.

Figure 6:
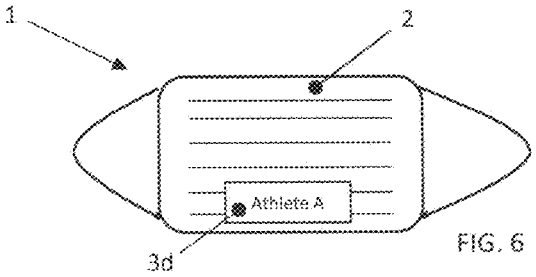
FIG. 6 is an illustration of the front of a face covering with an identification patch.
Figure 7:
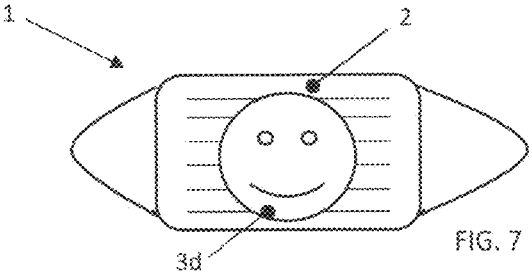
FIG. 7 is an illustration of the front of a face covering with an identification patch.
Figure 8:
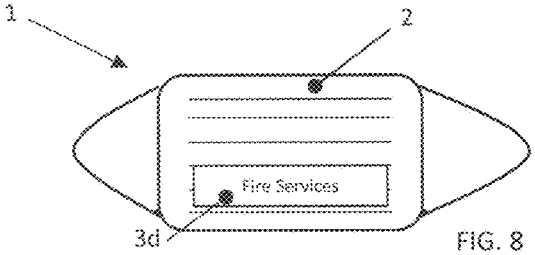
FIG. 8 is an illustration of the front of a face covering with an identification patch.

In some aspects, identification patches 3*d* (Athlete A FIG. 6, smiling face FIG. 7 and Fire Services FIG. 8) such as, but not limited to, a name, shape, number (FIG. 17), letter, figure or combination of a name, shape, number, letter or figure can be releasably attached to a fastening member 3 of the face covering 1. Where identification patches 3*d* (Athlete A FIG. 6, smiling face FIG. 7 and Fire Services FIG. 8) are fitted with one part of a two-part fastening material such as hook-and-loop type (Velcro™). The identification patches 3*d* could be fitted with the loop portion and the face covering 1 fastening member 3 could be the hook portion of a hook-and-loop fastener (Velcro™). However, the hook or loop portions are interchangeable when so desired.

Figure 22:
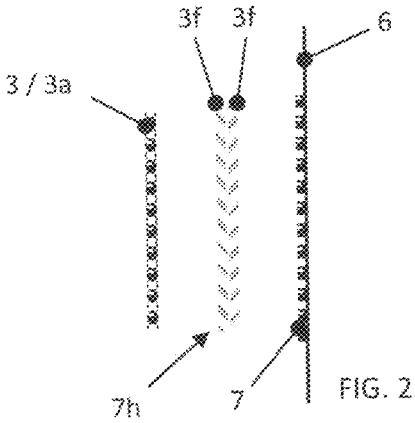
FIG. 22 is illustration of two hook portions of hook-and-loop material sewn or adhesively joined back-to-back.

In some aspects a "kit" (FIG. 11) may be provided for releasably affixing a face covering 1 to objects or items such as, but not limited to, a desk, wall, chair, apparel wears or similar. The kit may include a face covering 1 and a two-part hook-and-loop fastener (Velcro™) adhesive tape or sew on two-part hook-and-loop (Velcro™) material or similar, or an adaptor patch 7*h* (FIG. 22) consisting of sewn together or adhesively joined or the like back-to-back hook portions 3*f* of hook-and-loop material for attachment to other surfaces, clothing wears 6, armband 6*a* or other items including other face coverings 1. Part one of the two-part hook-and-loop fasting tape would include the loop portion 3*e* and part two would be the hook portion 7*a* (FIG. 11) or combinations of each or the hook-and-loop material may incorporate the hooks and loops into one piece combining part one and part two, such as (Velcro.™.) brand sew on snag free fasteners. The "kit" may also include a tag 3*b*, hook-and-loop material, identification patches 3*d*, clothing wear 6, armband 6*a*, cover patch 7*c*, removable patch 9, shipping bag 10 and a cover 8. Each item may independently be sewn or affixed in some manner to the clothing wear 6, armband 6*a* or other apparel wears (not shown) or the like as needed by the user.

A clothing wear 6 complete with attachment areas 7 may be provided as part of the "kit" or not as part of a "kit", but as part of a two-part method and system of attaching face coverings 1 to a clothing wear 6 or apparel wear. The attachment areas 7 sewn or attached to the clothing wear 1 are for the purpose of readily releasably attaching and deploying a face covering 1. The placement of the attachment areas 7 on the clothing wear 6 are mindful of the wearers ability to engage with the face covering 1 releasably attached to the clothing wear 6 and are sewn or attached in a manner that does not irritate the skin of the wearer while providing a location that allows single handed manipulation of the face covering 1. Additionally, the attachment areas 7 on the clothing wear 6 are mindful of cross contamination, as such, the attachment areas 7 are strategically placed to keep the face covering 1 held in place during physical activities, work activities, exercise activities, or similar activities. The position and arrangement of the attachment areas 7 additionally provides accountability for outside influences such as wind and air movement where the attachment areas 7 hold fast the face covering 1 during such conditions. If outside conditions such as rain or snow could affect the face covering 1 there is provided a washable cover 8 (FIG. 11 and FIG. 15) that is arrange to cover the face covering 1. Additionally, the face covering 1 may be sealed within a plastic shipping bag (FIG. 21) that could be affixable to a clothing wear 1 or other surface without removal of the shipping bag until needed by the user.

Figure 9A:
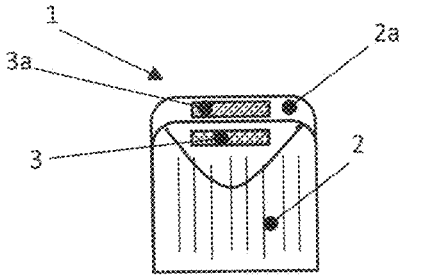
FIG. 9*a* is illustration of a folded face covering.

Previous prior art teachings using hook-and-loop (Velcro.™.) type fastening materials or snap buttons, magnetic fasteners or the like sewn or attached to apparel for attaching pictorial presentations, insignia, letters, numbers, logos, communication of a message or changing indicia on garments or placing fun figures provide no teachings of attaching face coverings 1 to apparel or a clothing wear 6. The clothing wear 1 or apparel complete with attachment areas 7, and/or cover patch 7*c*, and/or openable patch (FIG. 11*ab*, 11*ac*, 19, 20, 23, 24), and/or removable patch 9 and/or shipping bag 10 herein now provides teaching for attaching a face covering 1 to apparel or a clothing wear 6. Additionally, illustrated in (FIG. 12) some aspects the hook-and-loop (Velcro.™.) attachment areas 7 on the clothing wear 6 are uniquely place to correspond with a face covering 1 described herein where the loop 7*a* and hook 7*b* parts are strategically positioned to engage with fastening members 3 and fasting members 3*b* (FIG. 9*a*). Furthermore, an openable or removable (Velcor.™) backed cover patch 7*c* (FIG. 11*a*, 11*c*, 11*ab*, 11*ac*, 11*ad* and 11*ae*) made of fabric, silicone, plastic or like materials may be sewn with stretch material 7*e* or similar material, or attached by other means to a clothing wear 6 for the purpose of clamping over or holding a face covering 1 by the ear loops 4 or similar of a face covering 1. In some aspects the cover patch 7*c* is removable and not sewn to the clothing wear 6, in which case, the cover patch 7*c* can be provided as part of a kit or attached to prevent snagging outer wears (not shown). When the cover patch 7*c* is sewn to a clothing wear 6, stretch material 7*e* or similar material could be used to retain the cover patch 7*c* to the clothing wear 6 when the cover patch 7*c* is open, or not engaged with the hook-and-loop material. The openable end 7*d* may be attached to a clothing wear 6 with hook-and-loop (Velcro™) material, snap buttons, buttons, magnets or the like.

Figure 11A:
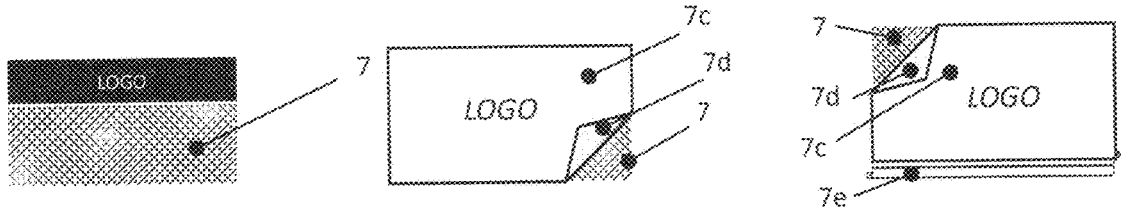
FIG. 11*a* is illustration of attachment areas and cover patch.
Figure 11A:
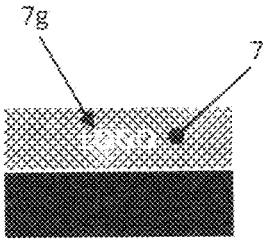
Figure 11A:
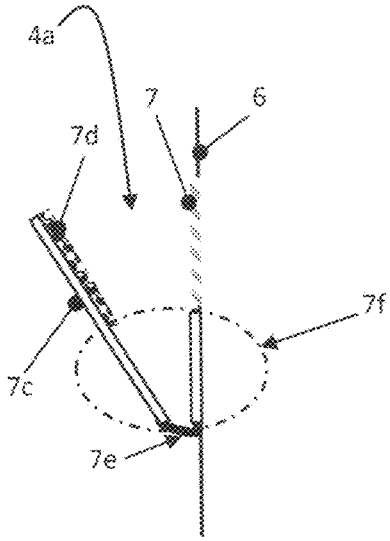
Figure 11A:
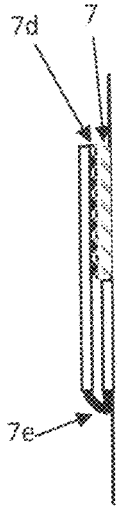
Figure 11A:
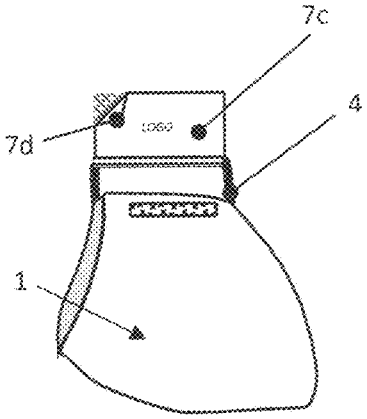
Figure 11A:
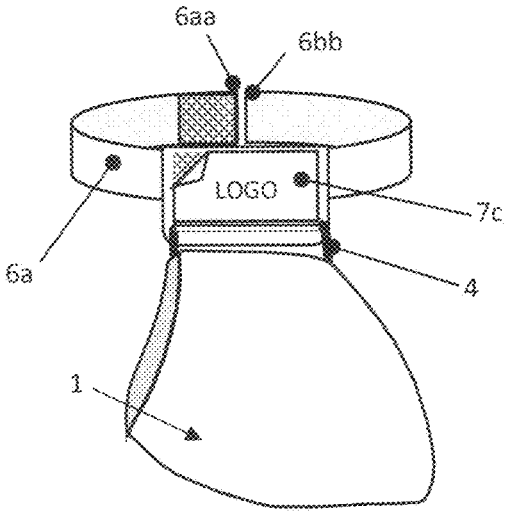
Figure 11B:
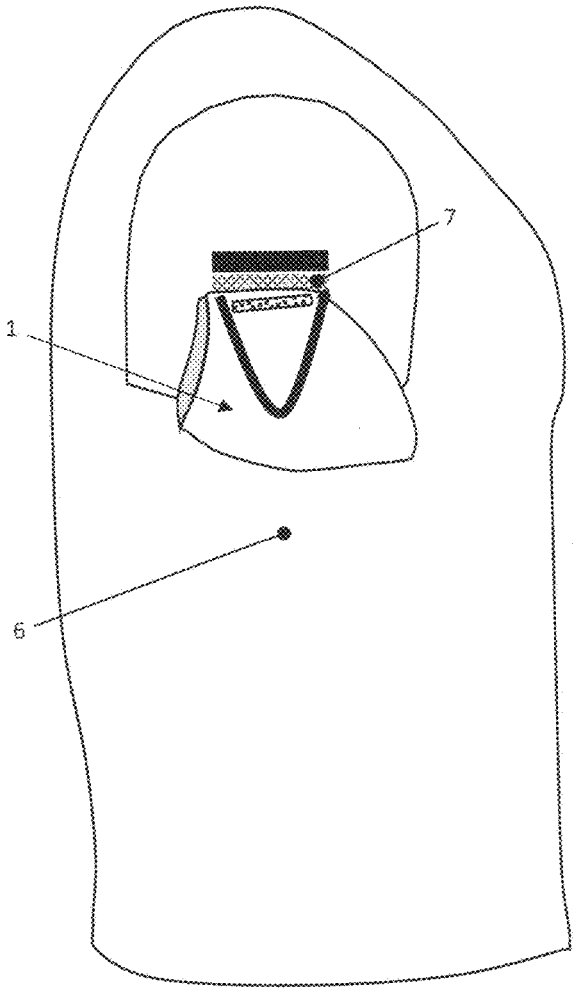
FIG. 11*b* is illustration of a face covering releasably affixed to a clothing wear.
Figure 11C:
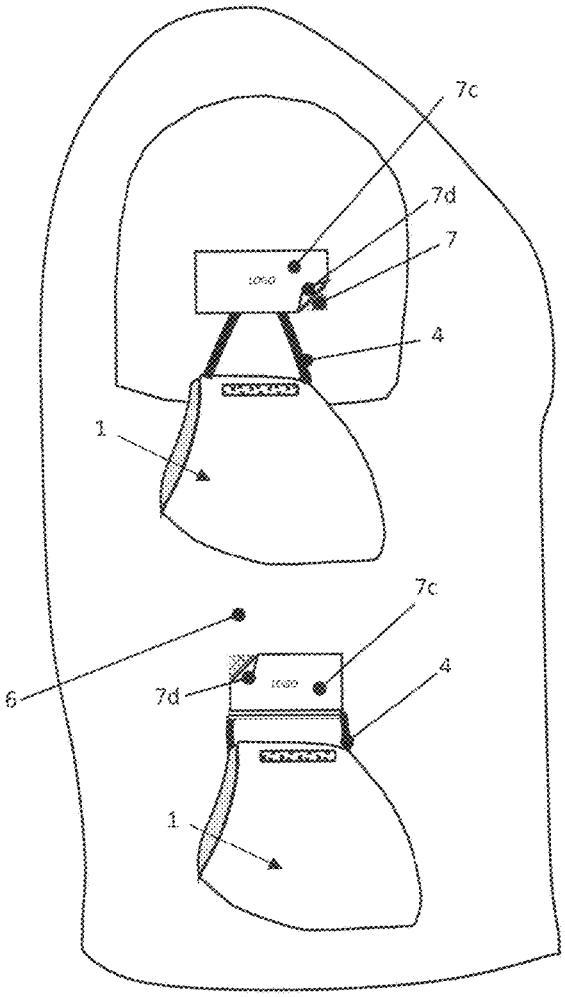
FIG. 11*c* is illustration of a face coverings releasably affixed to a clothing wear.
Figure 12:
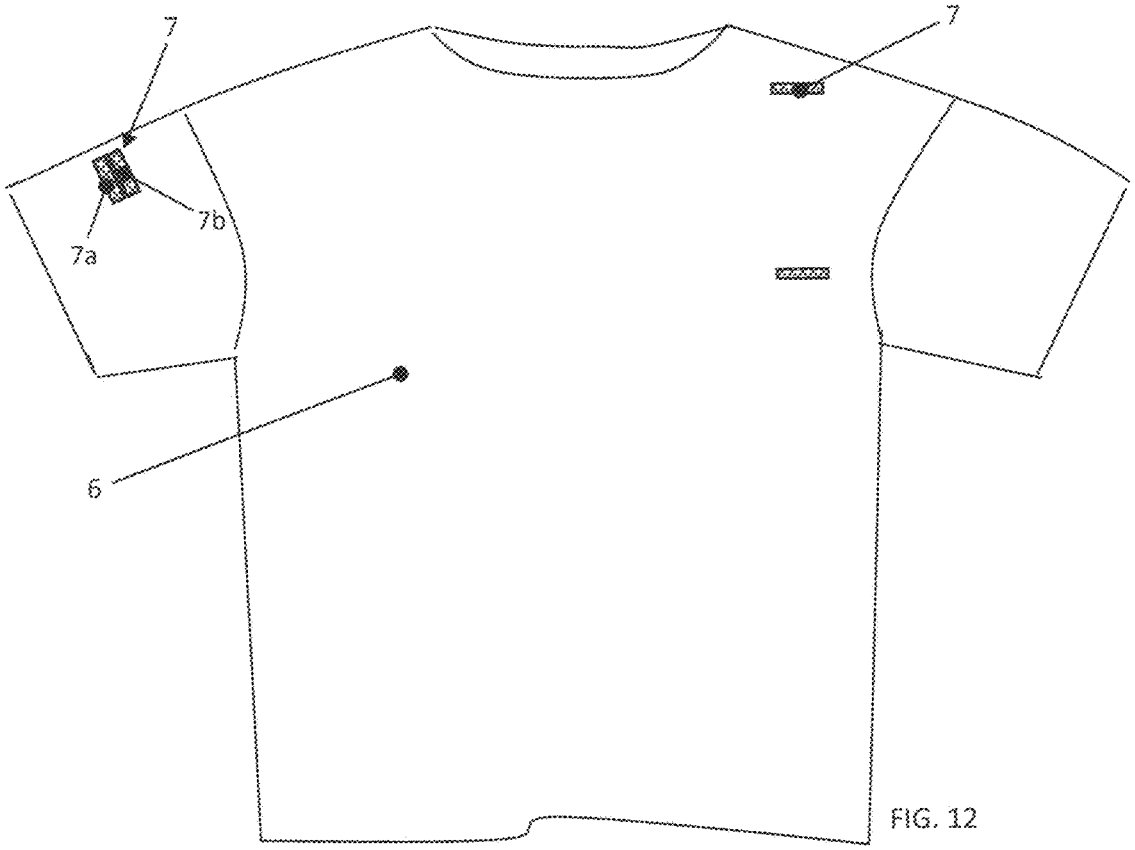
FIG. 12 is an illustration of a T shirt clothing wear with attachment areas.
Figure 13:
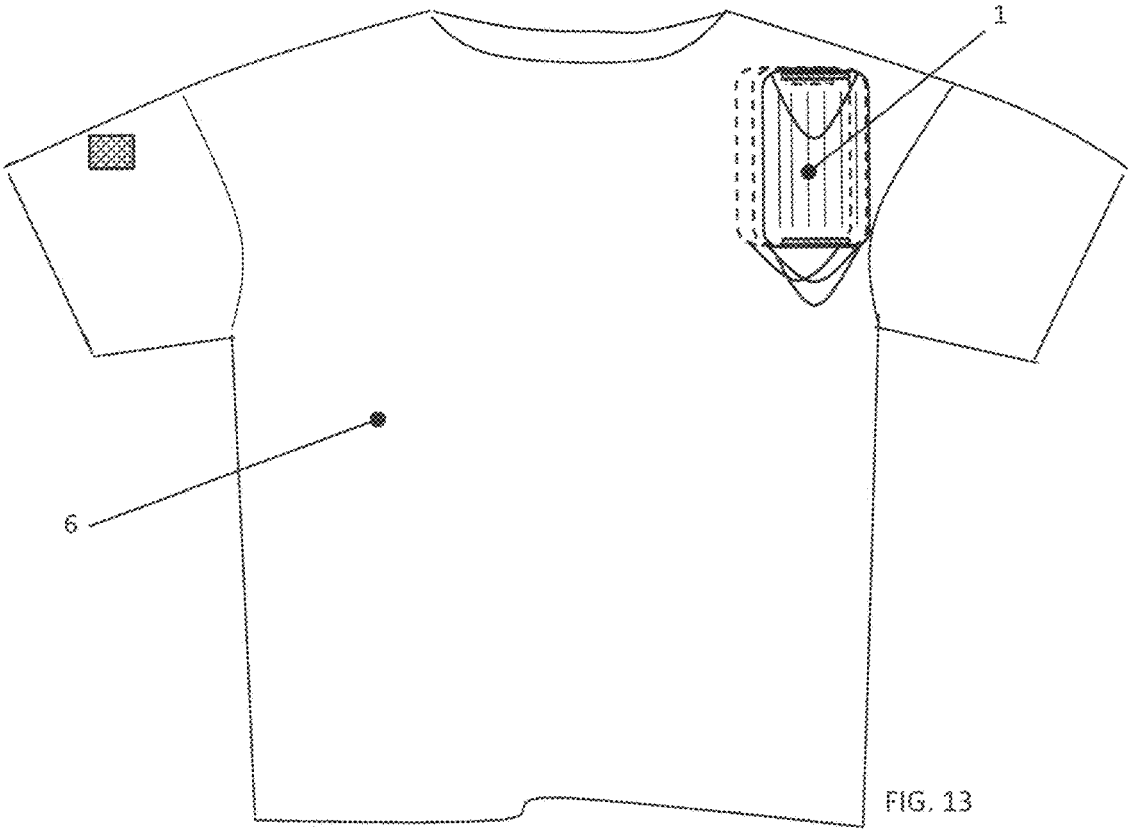
FIG. 13 is an illustration of a T shirt wear with a face covering releasably affixed near the chest area.
Figure 14:
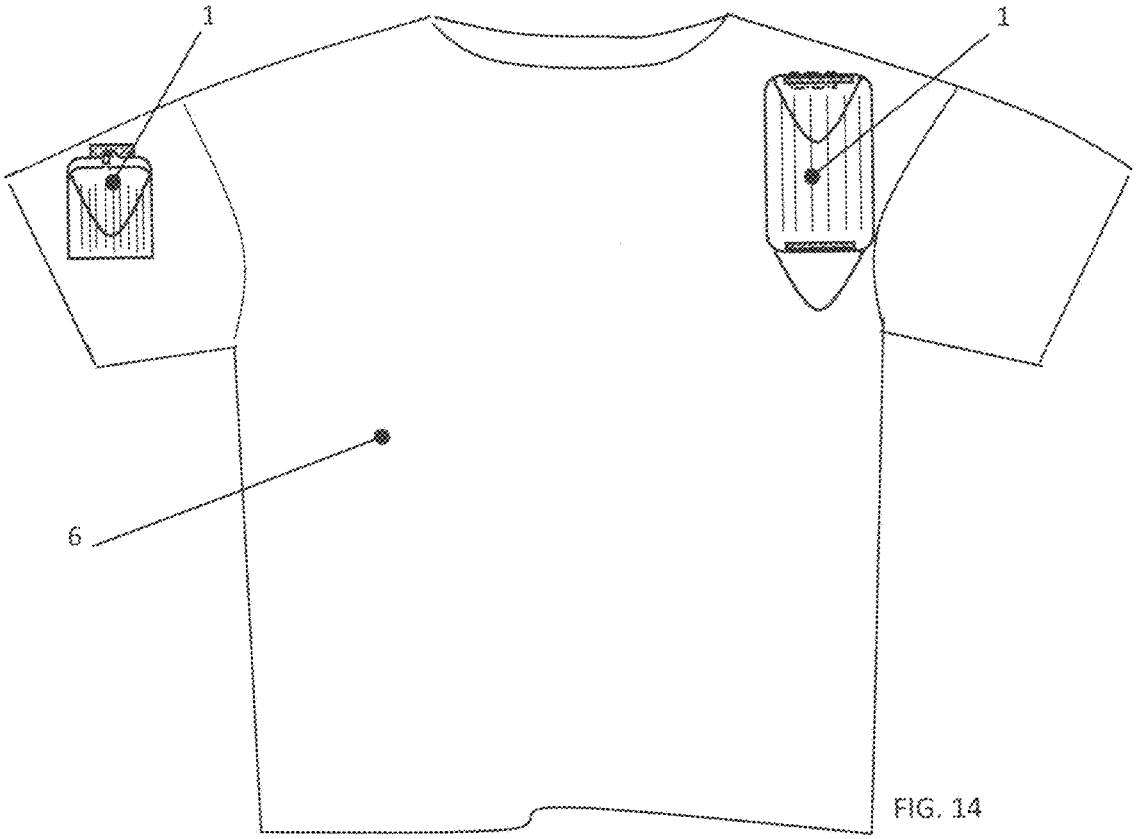
FIG. 14 is an illustration of a T shirt wear with a face covering releasably affixed near the chest area and a folded face covering releasably affixed near the shoulder area.
Figure 15:
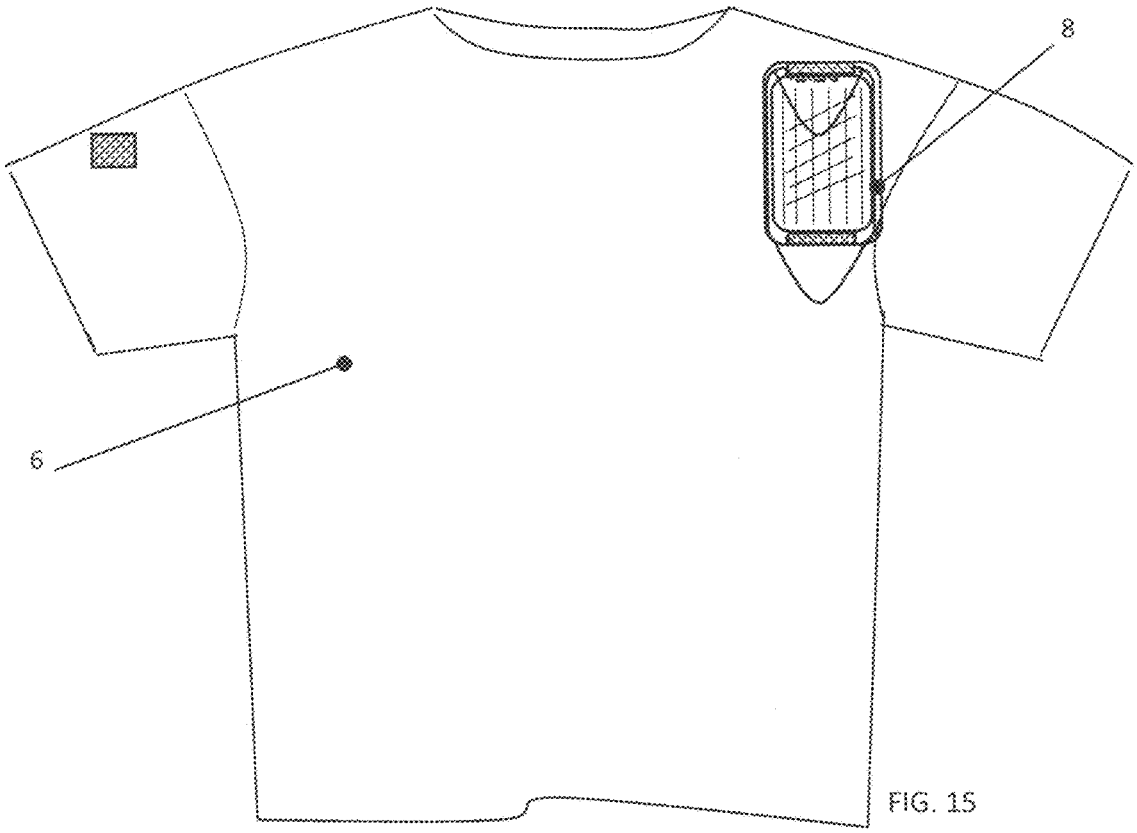
FIG. 15 is an illustration of a cover over a face covering affixed to a clothing wear.
Figure 16:
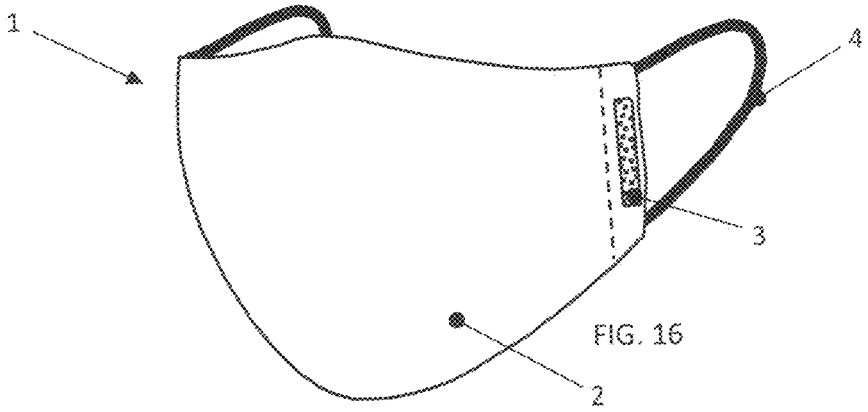
FIG. 16 is a perspective view of a face covering.
Figure 19:
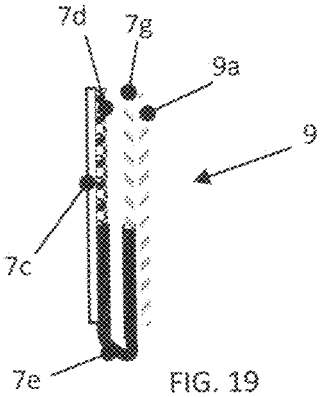
FIG. 19 is illustration of a "kit ready" removable patch.
Figure 20:
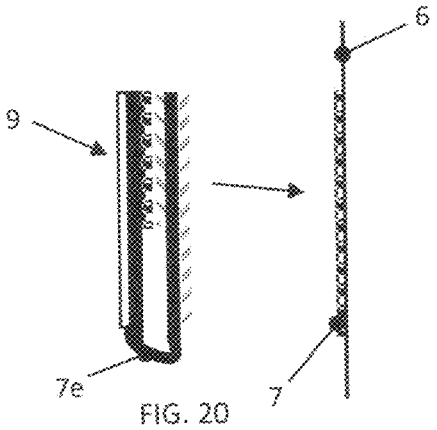
FIG. 20 is a side view of a removable patch path to clothing wear attachment area.
Figure 23:
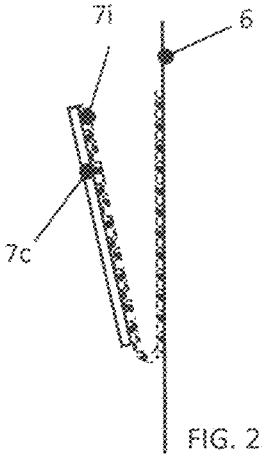
FIG. 23 is a side view of a cover patch with continuous hook-and-loop material.
Figure 24:
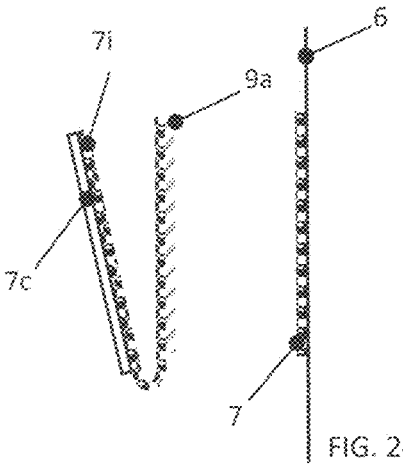
FIG. 24 is a side view of a openable patch with continuous hook-and-loop material.

FIG. 11*aa*, 11*ab*, 11*ac* provide further Illustration of a cover patch 7*c* where the hook-and-loop materials 7*d*, 7 do not extend completely throughout creating a void 7*f* for the purpose of holding the ear loops 4 in a manner that will not cause snagging of the ear loop 4 material. The cover patch 7*c* when opened allows the ear loops 4 to be inserted through the top opening 4*a* into the void 7*f*. However, it is to be understood that the cover patch 7*c* may be positioned in any directional orientation. When the cover patch 7*c* is closed the ear loops 4 are held secure within the void 7*f* area in a snag free manner. However, when hook-and-loop material fasteners incorporate the hooks and loops into one piece such as (Velcro.™.) brand sew on snag free fasteners 7*i* the hook-and-loop material may extend throughout the entire area, and in some cases extend as one continuous piece where the use of the stretch material 7*e* can be omitted (FIG. 23, 24). Additionally, logo branding may appear within hook-and-loop branded material 7*g*. It is to be understood for the purpose of manufacturing that all parts of the cover patch 7*c* including clothing wear 6 attachment areas are formed as one piece that can be sewn or attached to a clothing wear 6. It should also be understood that when not sewn or attached to a clothing wear 6 the assembled parts may be provided as part of a "kit" that can be sewn onto a clothing wear 6 or attached in some manner by the user. In a preferred configuration of a "kit ready" removable patch 9 (FIG. 19) the stretch material 7*e* and the loop portions of hook-and-loop material 7*d* are sewn or adhesively attached to the backside of the cover patch 7*c*. The same stretch material 7*e* sewn or adhesively attached to the backside of the cover patch 7*c* and hook portions 7*g* of hook-and-loop material are then sewn or adhesively attached to the back of a patch backing 9*a* being hook portions of hook-and-loop material. The removable patch 9 can be releasable engaged with other surfaces, clothing wears 6 (FIG. 20) armband 6*a* (FIG. 11*ae*) or the like as need by the user.

FIG. 11*ae* provides illustration of a face covering 1 releasable affixed to an armband 6*a* or leg band providing a method and means of transportation, storage and rapid deployment of a face covering 1 that is interchangeable from clothing apparel wears. The armband 6*a* generally a rectangular piece of cleanable or washable fabric, cloth, suede, leather, textile, plastic, or other relatively sturdy material having a respective front-facing and rear-facing surface. The front front-facing surface is engaged with retaining the face covering 1 and the rear-facing surface is wrapped around the arm or leg securing the armband 6*a* or leg band to the leg or arm of the wearer. The opposing free ends 6*aa* and 6*bb* carry complementary parts such as hook and loop (Velcro™) type material, slide release buckles (not shown), snap buttons (not shown) or other attachment method (not shown) to selectively and releasably adjust and secure the armband 6*a* or leg band to the leg or arm. Alternatively, closed self-adjusting cylindrical band of elastic fabric type material may provide another method of securing the armband 6*a* or leg band to the leg or arm.

Figure 17:
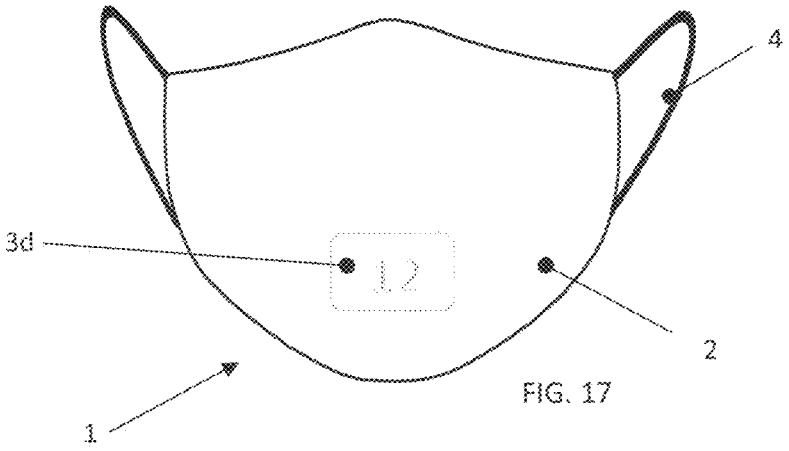
FIG. 17 is a front view of a face covering.
Figure 18:
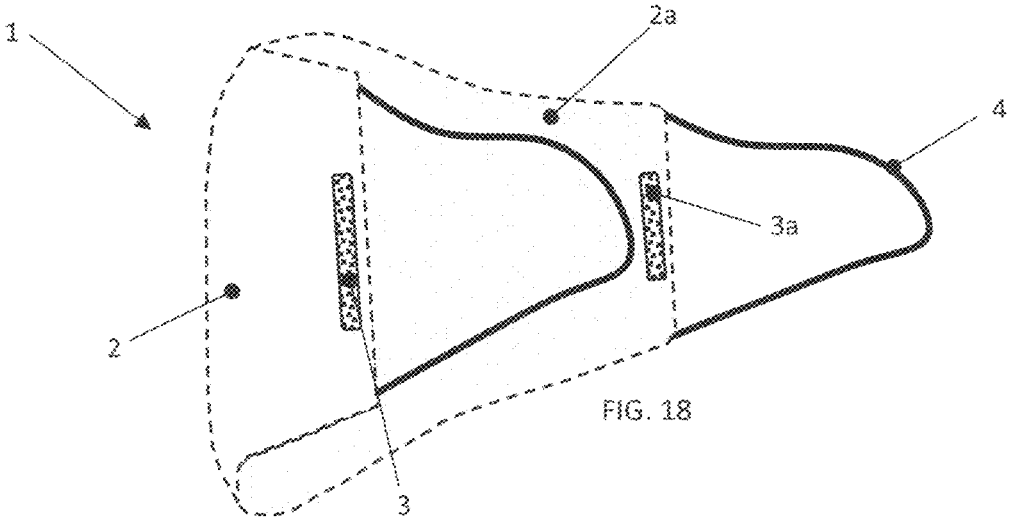
FIG. 18 is a perspective view of a side and back of a face covering.

FIG. 17 provides illustration of a face covering 1 wherein a fastening member 3 of the face covering 1 is affixed on an outside surface 2 near a side hem and FIG. 18 provides illustration of a face covering 1 wherein a fastening member 3 and fastening member 3*a* of the face covering 1 are affixed on an outside surface 2 and inside surface 2*a*. When folded generally in half the placement of fastening member 3 and fastening member 3*a* allow the face covering 1 to be held releasably engaged to corresponding fasteners affixed or formed in part, or in whole of other items, surfaces, devices, including apparel, armbands (FIG. 11*ae*), scrubs, clothing wears (FIG. 11*b*, 12), or openable patch (FIG. 11*ab*, 11*ac*, 19, 20, 23, 24).

Figure 21:
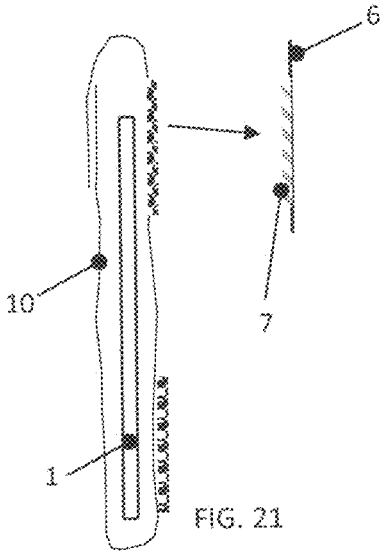
FIG. 21 is illustration of a hook-and-loop backed shipping and deployment bag.

FIG. 21 provides illustration of a face covering 1 enclosed within a deployment shipping bag 10 where hook-and-loop material is affixed to the exterior of the shipping bag 10 front or back surface for the purpose of engaging with hook-and-loop material of a clothing wear 6, armband 6*a*, or another surface. Providing a deployment shipping bag 10 in this manner allows the user to have a backup face covering not affected by external elements such as rain, dust, germs or the like that is readily available for deployment. Additionally, with hook-and-loop type materials, snap buttons (not shown) or similar fastening materials affixed on the front and back of the deployment shipping bag 10 it is possible that one or more than one deployment shipping bag 10 can be engaged with a clothing wear 6, armband 6*a*, cover patch 7*c*, removable patch 9, or other surface.

FIG. 23 provides illustration of an openable patch where the inside surfaces or snag free fasteners 7*i* or corresponding fasteners connect the cover patch 7*c* or outside surface of the openable patch to a clothing wear 6, wherein the continuous snag free fasteners 7*i* or inside surface(s) or corresponding fastener(s) is looped back or folded generally in half where the backside of the snag free fasteners 7*i* or inside surface(s) or corresponding fastener(s) can be affixed to the clothing wear 6. It is to be understood that the when the openable patch is in the open position the inside surfaces or snag free fasteners 7*i* or corresponding fasteners are exposed for engagement with fastening member 3, 3*a*, 3*c* of the face covering 1. Additionally, it is to be understood that the ear loop(s) 4 of said face covering 1 can be retained or held within the closed openable patch, whereby, the inside surfaces or snag free fasteners 7*i* or corresponding fasteners are engaged, thereby, releasably holding said face covering 1 by the ear loop(s) 4.

FIGS. 11*b*, 11*c*, 13, 14 and 15 provide illustration of a face covering 1 releasable affixed to a T shirt clothing wear 6 providing a method and means of transportation, storage and rapid deployment of a face covering 1. The clothing wear 6 attachment areas 7 (FIG. 12) illustrated are preferred locations that enable the user a single-handed approach to the removal of and releasably affixing a face covering 1 to a clothing wear 6.

The aforementioned invention, methods and approach to managing a face covering 1 provides first responders, individuals engaged in high intensity activities, or other individuals and persons an effortless enhanced sanitary means and method for face covering 1 storage, transportation and deployment.

The present invention has been illustrated and described with reference to particular embodiments thereof, it will be understood by those skilled in the art that other changes in form and detail may be made and are to be considered within the scope and essence of the present invention.

What is claimed is:

1. A face covering apparatus comprising:

an article of apparel to be worn by a wearer and including at least one first corresponding fastening member attached thereto on an exposed surface thereof so as to be exposed on the exposed surface;

wherein the at least one first corresponding fastening member is a plurality of sections including at least one outside surface, one backside surface and two inside surfaces, wherein said two inside surfaces are composed of one first inside surface and one second inside surface, wherein said one first inside surface is in fixed intimate connection with said one outside surface, and wherein said one second inside surface is in fixed intimate connection with said one backside surface, wherein said one first inside surface and said one second inside surface releasably engage, wherein said one outside surface and said one first inside surface overlay said one second inside surface when said one first inside surface and said one second inside surface are releasably engaged and configured in a closed position, wherein said one first inside surface and said one second inside surface are configured to be receiving of at least one second fastening member of a face covering device when said one first inside surface and said one second inside surface are disengaged and configured in an open position; and, wherein said one first inside surface and said one second inside surface are configured to be receiving and holding of at least one or more ear loops of said face covering device when said one first inside surface and said one second inside surface are engaged and configured in the closed position;

said face covering device configured to cover the nose and mouth of the wearer, comprising:

an inside surface configured to be when worn proximal to the face of the wearer; and, an outside surface configured to be when worn distal to the face of the wearer; and, a top end, a bottom end, and first and second sides on respective sides of a center line; and, first and second ear loops of the at least one or more ear loops each connected to the first and second sides respectively of the face covering device for securing said face covering to the face of the wearer; and, first fastening members, and second fastening members of said at least one second fastening member each on one of said inside surface or said outside surface at or adjacent a respective side, wherein the face covering device in a folded position exposes at least one of said first or second fastening members such that said first and second fastening members are positioned parallel to one another and releasably engage with said at least one first corresponding fastening member and cooperate to hold the face covering device in the folded position;

the first and second fastening members being releasable to allow the face covering device to be moved to an open unfolded position; and, at least one of the first or the second fastening members configured to releasably engage with and connect to said at least one first corresponding fastening member of said article of apparel;

wherein one of said at least one second fastening member is affixed to the outside surface of said face covering device so as to releasably fasten the outside surface of the face covering device directly to the at least one first corresponding fastening member; and, wherein one of said at least one second fastening member is affixed to the inside surface of said face covering device so as to releasably fasten the inside surface of the face covering device directly to the at least one first corresponding fastening member.

2. The apparatus according to claim 1 wherein said at least one second fastening member comprises one of the group including, hook and loop material, snap buttons and magnets.

3. The apparatus according to claim 1 wherein said article of apparel comprises one or more of armbands, leg bands, reflective apparel, safety vests, medical wearing apparel, scrubs, lab coats, athletic wearing apparel, T shirts, jerseys, sweaters, uniform wearing apparel, tunics, shirts, tactical gear work wearing apparel, coveralls, jackets and outerwear.

4. The apparatus according to claim 1 wherein said second fastening member is affixed to said face covering device by one of sewing, bonding, fusing, or gluing.

5. The apparatus according to claim 1 wherein the outside surface of said at least one first corresponding fastening member is fabric, silicone or plastic material capable of providing stability, sturdiness, rigidity, or firmness.

6. The apparatus according to claim 1 wherein said one backside surface of said at least one first corresponding fastening member is arranged for attachment to walls, chairs, desks and other surfaces.

7. The apparatus according to claim 1 wherein the outside surface of said at least one first corresponding fastening member is constructed at least in part of a resilient material including manufactured materials or natural materials.

8. The apparatus according to claim 1 a connecting material of said one first inside surface and said one second inside surface is a stretch material.

9. The apparatus according to claim 1 wherein a connecting material of said one first inside surface and said one second inside surface is a hook and loop material.

10. The apparatus according to claim 1 wherein said at least one first corresponding fastening member is a resilient material.

11. The apparatus according to claim 1 wherein said one first inside surface and said one second inside surface of said at least one first corresponding fastening member comprise magnets, snap buttons or hook and loop material.

12. The apparatus according to claim 1 wherein at least one said first and second ear loops of said face covering device is held between said one first inside surface and said one second inside surface of said at least one first corresponding fastening member when said one first inside surface and said one second inside surface are releasably engaged and configured in the closed position so as to achieve holding said first and second ear loops in a fixed position.

13. The apparatus according to claim 1 wherein said second fastening member is arranged so as to not compromise a seal or function of said face covering device, or the comfort of the wearer or intended usability of said face covering device.

14. The apparatus according to claim 1 wherein said second fastening member is affixed to said face covering device as a tag.

15. The apparatus according to claim 1 wherein said first and second fastening members are arranged to releasably engage with first and second fastening members of other face covering devices so as to manage a plurality of face covering devices to be grouped cohesively in one bundle.

16. The apparatus according to claim 1 wherein said second fastening member of said face covering device are arranged to releasably engage with corresponding fastening members of identification patches or devices for the purpose of identification or personalization of said face covering devices.

17. The apparatus according to claim 1 wherein said one first inside surface and said one second inside surface of said at least one first corresponding fastening member is formed entirely throughout of self-engaging single-component hook & loop material, wherein said one first inside surface and said one second inside surface are configured to be releasably self-engaging when folded, and retaining of said at least one first corresponding fastening member's outside surface when disengaged or unfolded.

18. The apparatus according to claim 1 wherein said one second inside surface of said at least one first corresponding fastening member is self-engaging single-component hook & loop material configured to be directly affixed to an article of apparel.

19. The apparatus according to claim 1 wherein said one first inside surface connected to said one outside surface releasably engages with said article of apparel with hook and loop material, snap buttons or magnets.

20. The apparatus according to claim 1 wherein said two inside surfaces of said at least one first corresponding fastening member and said outside surface of said at least one first corresponding fastening member are formed as one piece.

* * * * *